US008215615B2

(12) United States Patent
Niklasson

(10) Patent No.: US 8,215,615 B2
(45) Date of Patent: Jul. 10, 2012

(54) WEDGE-FORMED LIFTING CUSHION

(76) Inventor: Karl-Olof Niklasson, Lysekil (SE)

( * ) Notice: Subject to any disclaimer, the term of this patent is extended or adjusted under 35 U.S.C. 154(b) by 528 days.

(21) Appl. No.: 12/090,856

(22) PCT Filed: Oct. 23, 2006

(86) PCT No.: PCT/SE2006/001195

§ 371 (c)(1),
(2), (4) Date: Apr. 19, 2008

(87) PCT Pub. No.: WO2007/050016

PCT Pub. Date: May 3, 2007

(65) Prior Publication Data

US 2008/0210917 A1 Sep. 4, 2008

(30) Foreign Application Priority Data

Oct. 25, 2005 (SE) ..... 0502360
Dec. 1, 2005 (SE) ..... 0502623
May 17, 2006 (SE) ..... 0601098

(51) Int. Cl.
*B66F 3/35* (2006.01)

(52) U.S. Cl. ..... 254/93 HP; 254/93 R

(58) Field of Classification Search ..... 254/93 R, 254/93 HP

See application file for complete search history.

(56) References Cited

U.S. PATENT DOCUMENTS 3,990,681 A * 11/1976 McKeen, Sr. ..... 254/88
4,060,170 A 11/1977 Walters
4,518,151 A * 5/1985 Dill, Jr. ..... 254/93 HP
4,948,107 A * 8/1990 Orndorff, Jr. ..... 254/93 HP
6,298,539 B1 * 10/2001 Dissing ..... 29/426.5
6,511,046 B1 * 1/2003 Solakian ..... 254/93 HP

FOREIGN PATENT DOCUMENTS

EP 0088506 A1 9/1983
EP 0115199 A1 8/1984
WO 79/00753 A1 10/1979

OTHER PUBLICATIONS

Swedish Patent Office, Int'l Search Report in PCT/SE2006/001195, Feb. 28, 2007.
Swedish Patent Office, Int'l Report on Patentability in PCT/SE2006/001195, Apr. 29, 2008.

* cited by examiner

*Primary Examiner* — Lee D Wilson
*Assistant Examiner* — Shantese McDonald
(74) *Attorney, Agent, or Firm* — Potomac Patent Group PLLC

(57) ABSTRACT

The invention relates to a lifting cushion (20) that is wedge-shaped and is formed by a top part (1) and a bottom part (2) with connecting walls (3-33), and which is arranged to be tillable with fluid, e.g., air, gas or liquid. The top part (1) and the bottom part (2) are joined to a common unit (21) in the forward edge (4) of the cushion, and said forward edge (4) is extended in relation to the front wall (3) of the lifting cushion and forms thereby a thin fore extended part (21) in front of said front wall (3) and that is active during the insertion but passive during operation. Said fore part (21) of the wedge-shaped lifting cushion is arranged in such a way that when the lifting cushion (20) is filled with fluid, the fore extended top part (1) and the bottom part (2) are expanded without preventing the fore wall (3) of the lifting cushion from smoothing out and forming the fore part of the lifting cushion in a filled state.

14 Claims, 7 Drawing Sheets

WEDGE-FORMED LIFTING CUSHION

Figure 1:
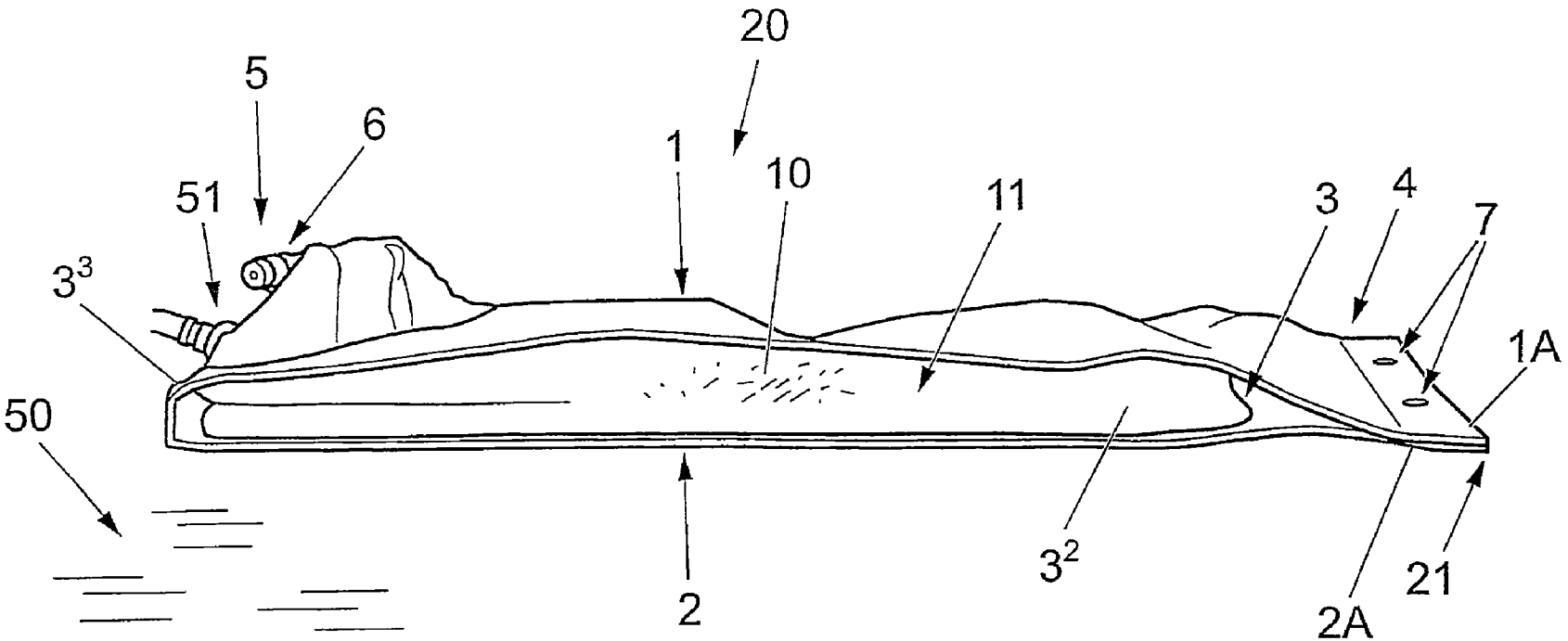

The present invention relates to a lifting cushion that is wedge-shaped and is formed by a top part and a bottom part with connecting walls, and which is arranged to be fillable with a fluid, e.g., air, gas or liquid.

In accidents where a vehicle and people are involved, there is a need to be able to lift up the vehicle from the ground quickly. This is the situation that, e.g., applies for a severe bus accident where passengers are lying caught under the bus, or, e.g., in a tanker-lorry accident where environmentally damaging substances risk leaking out into the environment and polluting, or in the danger of fire and explosion.

Known solutions to allow lifting the entire or parts of overturned vehicles comprise thick inflatable cushions. Said cushions are known formed with a fore edge that is thick and formed by the accumulated layers of the cushion piled on each other, wherein said edge may be difficult to insert between, e.g., the ground and the wrecked vehicle in question, and through narrow spaces. Lifting of the vehicle, for example, is desired to be made quickly to be able to save lives and/or the environment.

Hence, the main object of the present invention is primarily to solve said problems in a simple, reliable and efficient way with properly functioning means therefor.

Said object is attained by means of a lifting cushion according to the present invention, which substantially is characterized in that the top part and the bottom part, as well as also the other parts of the same, that consist of a formable material, e.g., rubber material, plastic material, composite material or a combination thereof, are joined to form a common unit in the forward edge of the cushion, that said forward edge is extended in relation to the front wall of the lifting cushion and thereby forms a thin fore extended part, which extends in front of and outside said front wall, and that said fore part of the wedge-shaped lifting cushion is so thin and stiff that when the lifting cushion is filled with fluid, the fore extended top part and the bottom part are expanded without preventing the fore part of the wall of the lifting cushion from smoothing out and forming the fore part of the lifting cushion in a filled state, so that it is allowed to be interposable along a support under or between objects to be lifted.

Thus, the object of the present invention is to provide a lifting cushion, which is arranged to function by being filled with air, gas or the like or different kinds of liquids, which has a reinforced bottom and top, which in the forward edge thereof is extended and joined to one unit, and which thereby forms a lifting cushion the fore part of which is so thin that it, thanks to this, readily can be inserted into narrow spaces without obstruction from any fore folded wall of the lifting cushion.

A breaking or lifting device previously known by WO 7900753 A1 comprises an inflatable bellows (47) having branches (48, 49) situated on each side of the same, similar to a bellows having stiff operable faces. The two stiff faces (48, 49) are joined to each other at the outer ends thereof via a pivot joint (58).

The main idea of the present invention is that the lifting cushion desirably should be inserted in a compressed unfilled state into narrow spaces in order to, in position, be able to expand the lifting cushion (20) contained therein. A fore part (21) of said lifting cushion (20) is withdrawn from the fore transverse withdrawn wall (3) of the lifting cushion (20). This is hardly the case with the known breaking or lifting device according to the cited publication, where the thickness of the stiff faces (48, 49) in the flattened state also comprises the thickness of the bellow (47) in the collapsed state. It can hardly be this technical feature that is intended to be solvable by the previously known device according to WO 7900753 A1,unlike what is the case according to the present invention.

The function of said known breaking or lifting device should become the opposite in relation to the lifting cushion defined now in the new claim 1. This should be a technically unexpected effect.

U.S. Pat. No. 4,060,170 A discloses a lifting device formed by a fluid-fillable cushion including a laterally displaceable jack. In that connection, the entire cushion may be filled with fluid, however, in doing so, no thin extended forward edge that easily can be inserted into narrow spaces is formed.

U.S. Pat. No. 3,990,681 A relates to a wedge-shaped wheel-lifting device having a bridging part (19) at the low edge of the lifting device in order to facilitate driving with the wheel onto the wedge-shaped fluid-fillable lifting device (10). Said part (19) is not essential to the shown known lifting device.

Figure 2:
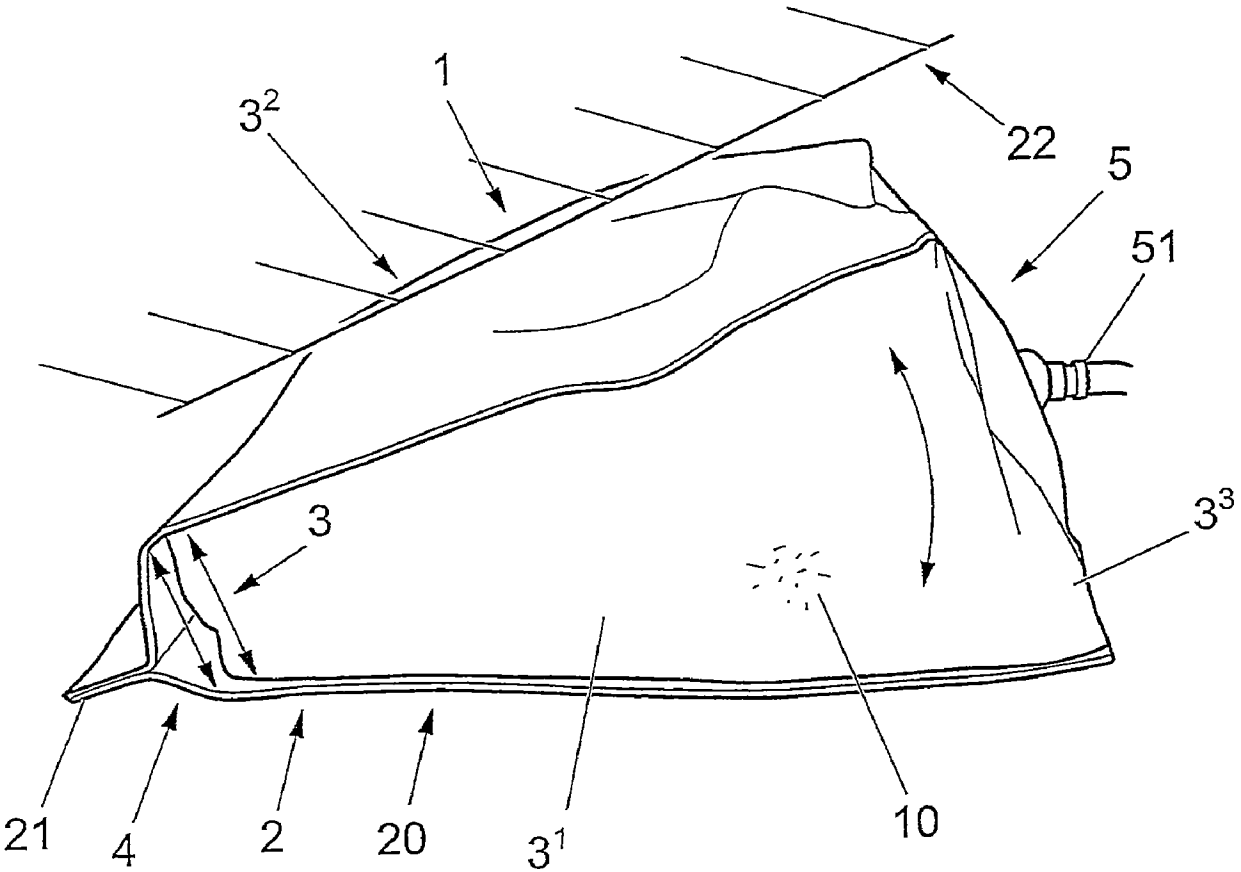
Figure 3:
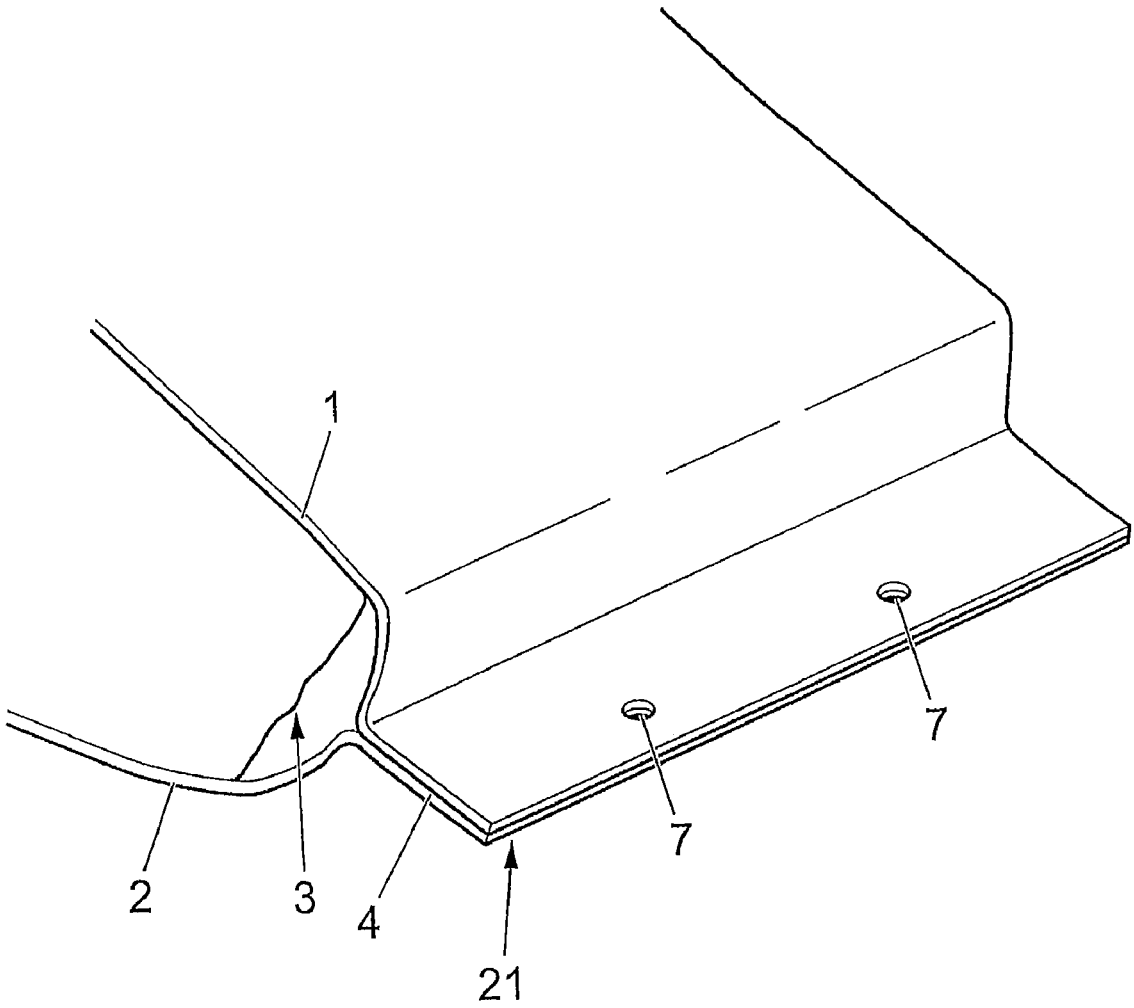
Figure 4:
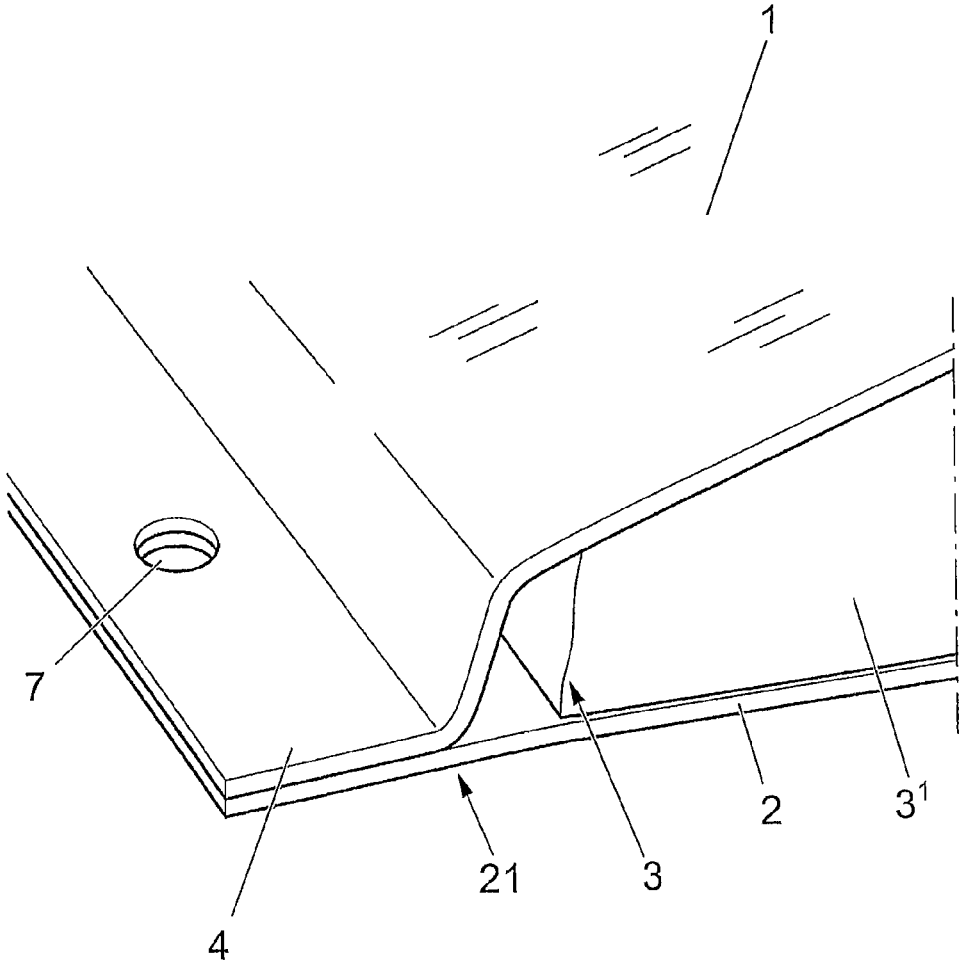
Figure 5:
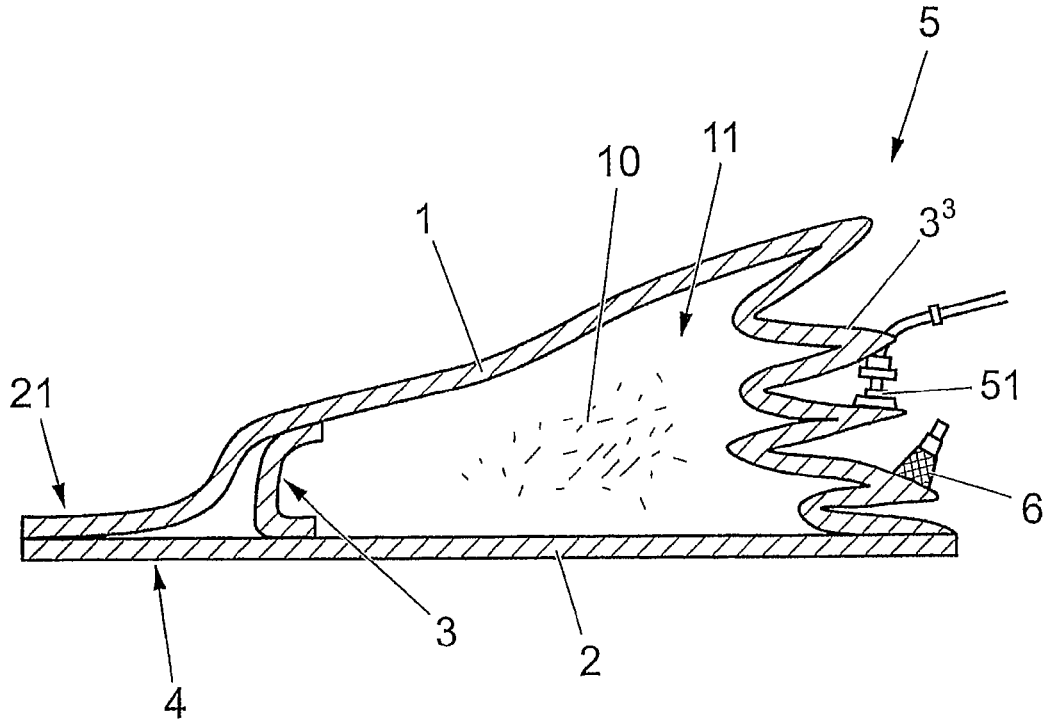
Figure 6:
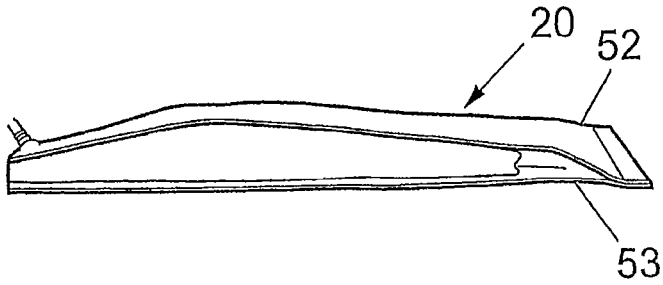
Figure 7:
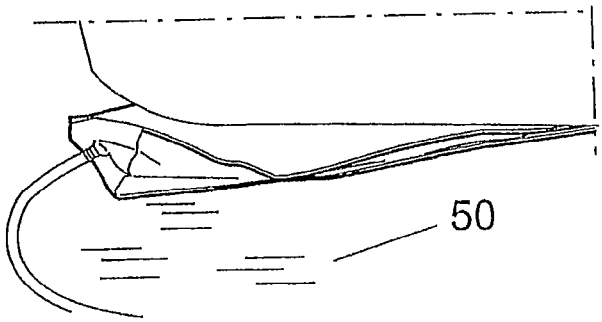
Figure 8:
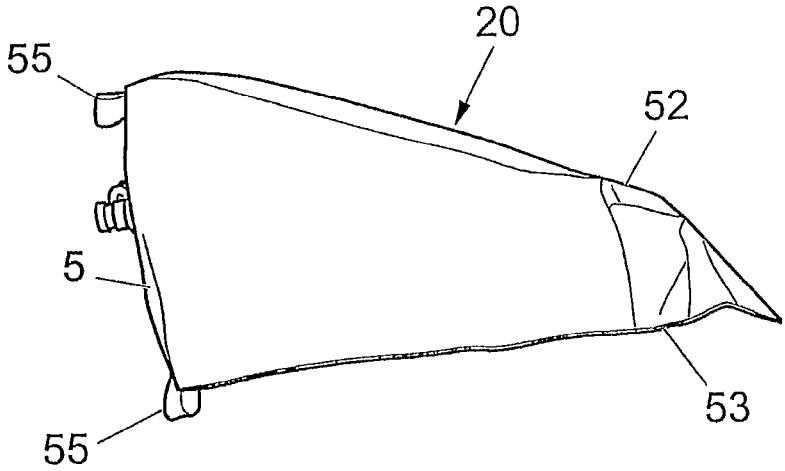
Figure 9:
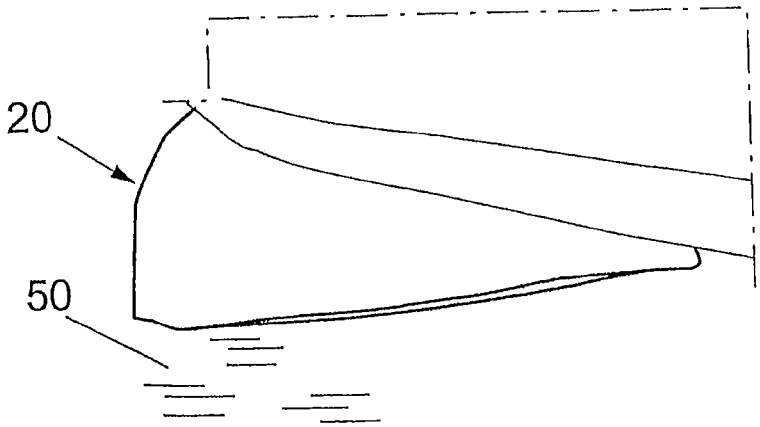
Figure 10:
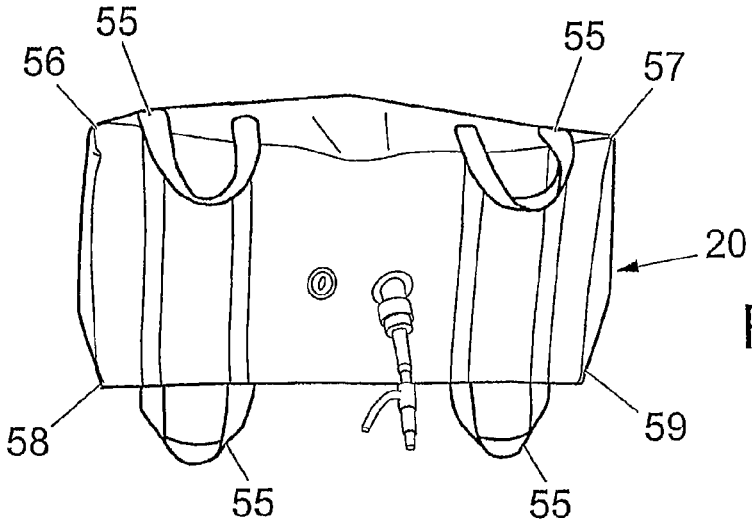
Figure 11:
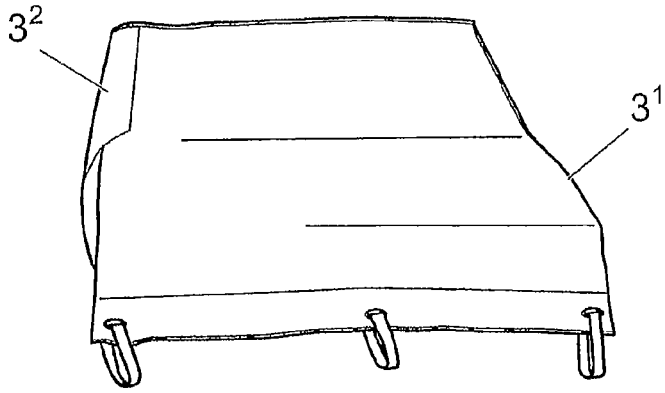
Figure 12:
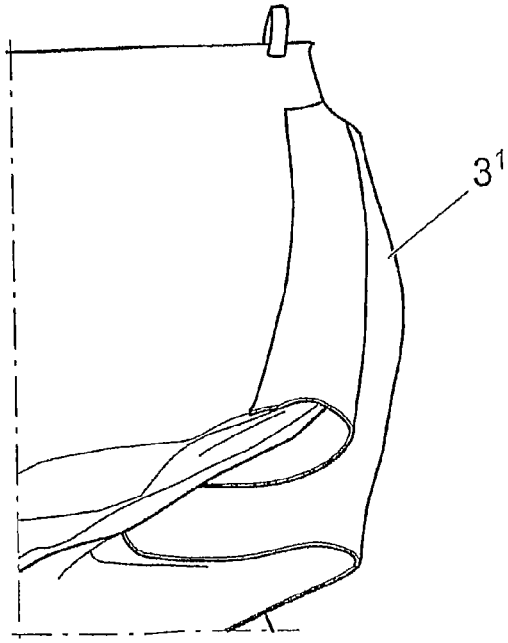

The invention is described below in the form of a number of preferred embodiment examples, reference being made to the accompanying drawings, in which, FIG. 1 shows a perspective view of a substantially air-evacuated lifting cushion, FIG. 2 shows the lifting cushion in an air-filled lifting state, FIG. 3 shows an example of the fore part of a lifting cushion, FIG. 4 shows an additional example of the front part of a lifting cushion as well as the lateral part thereof, FIG. 5 shows a lateral section view of a lifting cushion during the filling stage thereof, FIGS. 6-12 shows an additional embodiment example of the invention where FIG. 6 shows a lifting cushion in a compacted state, FIG. 7 shows the lifting cushion in an active lifting state in the beginning, FIG. 8 shows the lifting cushion in an inflated state, FIG. 9 shows the lifting cushion in an inflated lifting state in the final stage, FIG. 10 shows the lifting cushion inflated as seen from the rearward edge thereof, FIG. 11 shows the lifting cushion in a reversed state, and FIG. 12 shows one side of the lifting cushion in a compacted air-evacuated state.

According to the invention, a lifting cushion 20 is formed that is wedge-shaped by a top part 1 and a bottom part 2 with connecting walls 3, $\mathbf{3}^1$, $\mathbf{3}^2$, $\mathbf{3}^3$ around the circumference of the entire lifting cushion, and which lifting cushion 20 is arranged to be fillable with fluid 10, such as, e.g., air, gas or liquid. Said top part 1 and bottom part 2 are joined, e.g., by vulcanization, agglutination, needlework or another suitable joining technique to form a common unit 21 in the forward edge 4 of the cushion 20.

Said forward edge 4 is extended in relation to the front wall 3 of the lifting cushion and thereby it forms a thin fore extended front part 21, which extends in front of and outside said front wall 3. Thereby, a lifting cushion 20 is obtained, the fore part 21 of which is so thin as well as stiff that it is readily allowed to be interposable along a support 50 under or between objects 22 to be lifted and to be able to make the first lifting so that it is subsequently possible to find space to insert larger lifting cushions if this is needed. By the wedge-shape of the cushion and the thin forward edge 4 thereof, a unique combination is obtained of a thin cushion 20, which readily can be inserted under the object 22, and subsequent insertion of a larger lifting cushion, which can lift the entire object 22 at a safe and favourable radius obtained to the object 22 during the lifting procedure. This is by placing the wedge cushion under said large lifting cushion upon the continued lifting.

The fore wedge-shaped part 4 of the cushion 20 is arranged in such a way that when the lifting cushion 20 is filled with a suitable fluid 10, the fore extended top part 1 and the bottom part 2 are expanded and straightened out without preventing the fore wall 3 of the lifting cushion from smoothing out and forming the fore part of the lifting cushion 20 in a filled state.

The sides of the lifting cushion consist of a formable material, as well as also the other parts of the same, e.g., rubber material, plastic material, composite material or a combination thereof, and that preferably is provided with suitable reinforcement to be able to manage to resist the contained high pressure required to achieve the intended purpose. In that connection, the top 1 and bottom 2 of the lifting cushion may be composed of formed, preferably reinforced, material, which may have a hard or a soft surface directed outward. The bottom surface and the top surface of the bottom part 2 and the top part 1, respectively, may have equally large surface as the circumference of the actual lifting cushion or be larger than this so that it is outside the same and the limiting edge thereof extends outside the same.

In the forward edge 4 of the lifting cushion 20, the top part 1 and bottom part 2 of the lifting cushion are joined to each other, which are extended outside the actual fillable lifting cushion 20 and the front wall 3 thereof, so that the extensions 1A, 2A of the two parts 1, 2 form a common forward-edge unit 21. Said unit 21 may be provided with a number of anchor loops 7 so that the raised object 22, e.g., a car, can be moved by means of the wedge-shaped cushion 20 if, e.g., wires, etc., are attached in said loops 7 and pulling. This design also allows to spread apart two objects that desirably should be spaced apart in relation to each other, e.g., in a pit or in other similar situations. By means of, e.g., a rod that is attached in said loops 7, the flattened lifting cushion 20 can easily be guided to be pushed in through the intended opening, even if this is small, before inflation with a suitable fluid.

The fore wall 3, sides $\mathbf{3}^1$, $\mathbf{3}^2$ and rearward edge 5 of the cushion consist of formable, preferably reinforced, material, having a hard or soft surface.

The fore wedge-shaped part 21 is arranged in such a way that when the lifting cushion 20 is filled with fluid, the fore extended top part 1 and the bottom part 2 are expanded without preventing the fore part of the wall 3 of the lifting cushion from smoothing out and forming the fore part of the lifting cushion in a filled state, and by the wedge-shape of the cushion, a reliable lifting process takes place and the lifting is effected at a favourable radius to the object.

Thus, said extended part 21 is only active during the proper insertion stage of the lifting cushion 20 through the intended opening. After that, it is passive while he front wall 3 of the cushion and the remaining part of the cushion 20 are active during the proper lifting process. See, for instance, FIG. 2.

The circumferential sides of the lifting cushion consist of a formable material, which preferably is provided with reinforcements in order to stand the pressure required for the intended purpose, and the top part 1 and bottom part 2 of the lifting cushion are preferably substantially quadrangular and have a decreased wedge-shape toward the forward edge 4 thereof. The height ratio of the cushion 20 may be approx. 1:3 between the forward edge 4 and rearward edge 5 of the inflatable part of the cushion 20.

In the rearward edge 5 of the wedge-shaped cushion, there is a connection 51 to fill the inner space 11 of the cushion with a fluid 10 and evacuate the same from fluid, respectively. In the rearward edge 5 of the wedge-shaped cushion 20, there is also a safety valve 6, which prevents over-filling of the cushion 20 with fluid 10.

By means of the wedge-shaped cushion 20, which is thinner than designs known today, the possibility is provided of inserting the wedge-shaped cushion under the vehicle 22 in a fast and reliable way without needing to dig or in another way provide space for other lifting devices.

In the drawings, additional embodiment examples of the invention are shown in FIGS. 6-12 and where the material in the sides $\mathbf{3}^1$, $\mathbf{3}^2$ and rearward side $\mathbf{3}^3$, respectively, of the cushion consists of Kevlar material, while the material in the top- and underside 52, 53 of the cushion consists of fabric-reinforced rubber cloth. The rubber cloth protects the top- and underside 52, 53 of the wedge-shaped lifting cushion 20 while the built-in protection of Kevlar material protects the sides $\mathbf{3}^1$, $\mathbf{3}^2$ of the cushion 20 without this affecting the height of the cushion upon the insertion of the cushion 20 under the object to be lifted, while the Kevlar material in the rearward side $\mathbf{3}^3$ of the cushion protects the cushion against damage due to, e.g., the ground 50.

The design is also based on reinforcing, at an increased pressure in the lifting cushion 20, the Kevlar cloth in the sides $\mathbf{3}^1$, $\mathbf{3}^2$ of the wedge cushion so that it can work at a high pressure. Today, the pressure in the cushions is approx. 1.0 bar, but this pressure may be increased in order to achieve lifting forces of at least 7000 kp.

By arranging carrying handles 55 in the form of lifting belts at the rearward edge 5 of the lifting cushion and, if so, preferably at the four corner areas 56-59 of the cushion, since the cushion is quadrangularly shaped, the cushion 20 can be operated in many different ways, and which opens up new possibilities of using the same.

Thanks to real carrying handles in the rear part of the wedge cushion 20, it is easy to carry it.

The carrying handles 55 in the rearward edge of the wedge cushion 20 provide new possibilities of being able to lift it up in, e.g., towers or on the outside of buildings and there press apart items or objects. It may, e.g., be lowered into pits or inserted into pipes or culverts in order to press apart parts that block passage. Thus, it may be applied in other situations where other solutions to succeed are lacking.

Said wedge-shaped lifting cushion 20 is only 8 mm thick in the forward edge and makes it possible to bring in the cushion 20 also in the most severe situations. The lifting height is approx. 15 cm in the forward edge and approx. 40 cm in the rearward edge, and the dimension of the sides of the lifting cushion may suitably be approx. 70 cm×70 cm.

In order to additionally facilitate the insertion of the lifting cushion 20 under or between objects to be lifted or moved, wire loops 7 are vulcanized into the structure according to the above mentioned, so as to be able to fix tools therein that are considerably thinner than a regular boat hook. If it is possible to avoid digging in order to bring the cushion under, it is possible to save several vital minutes during rescue operations.

The unique properties of the wedge-shaped cushion by being extremely thin and furthermore having a lifting height that allows starting the use of other lifting devices, e.g., high-lift lifting cushions, quickly in order to save lives and prevent damage to the nature, gives the time saving that may be the difference between life and dead or that may prevent a devastating environmental disaster.

Naturally, the invention is not limited to the embodiments described above and shown in the accompanying drawings. Modifications are feasible, particularly as for the nature of the different parts, or by using an equivalent technique, without departing from the protection area of the invention, such as it is defined in the claims.

The invention claimed is:

1. A lifting cushion that is wedge-shaped, comprising:

a top part and a bottom part with connecting walls and fillable with a fluid, wherein the top part and the bottom part are a formable material and are joined to form an unbroken unit in a forward edge of the cushion, the forward edge is extended in relation to a front connecting wall, thereby forming a fore extended part that extends in front of and outside the front connecting wall, the front connecting wall extending substantially perpendicular to the bottom part in a filled state, the fore extended part is thin and stiff such that when the lifting cushion is filled with the fluid, the fore extended top part and the bottom part are expanded without preventing the fore extended part of the connecting wall from smoothing out and forming the fore part of the lifting cushion in a filled state, so that it is allowed to be interposable along a support under or between objects to be lifted, the top part and the bottom part have surfaces that are at least as large as a surface of the lifting cushion, the front connecting wall, sides, and a rearward edge of the cushion are a formable material, and a ratio of a height of the forward edge and a height of a rearward edge of an inflatable part of the cushion is approximately 1:3, and the lifting cushion has decreased wedge-shape toward the forward edge.

2. The lifting cushion of claim 1, wherein the fluid is air, gas, or liquid, and the formable material is a rubber, plastic, composite, or a combination thereof.

3. The lifting cushion of claim 1, wherein the formable material is reinforced and has a hard or soft surface.

4. The lifting cushion of claim 1, wherein circumferential sides of the lifting cushion are a formable material able to withstand pressure of the fluid.

5. The lifting cushion of claim 4, wherein the circumferential sides include reinforcements.

6. The lifting cushion of claim 4, wherein the circumferential sides and rearward side of the lifting cushion are Kevlar material.

7. The lifting cushion of claim 1, wherein the bottom part and top part include anchor loops.

8. The lifting cushion of claim 1, wherein a rearward edge includes a connection for filling an inner space of the cushion with the fluid and for emptying the inner space of the fluid.

9. The lifting cushion of claim 1, wherein a rearward edge includes a safety valve.

10. The lifting cushion of claim 1, wherein the top part and the bottom part are substantially quadrangular.

11. The lifting cushion of claim 1, wherein a top side and an under side are fabric-reinforced rubber cloth.

12. The lifting cushion of claim 1, further comprising carrying handles arranged at a rearward edge.

13. The lifting cushion of claim 1, wherein the top part and the bottom part are joined to form the unbroken unit in the forward edge of the cushion by at least one of vulcanization, agglutination, and needlework.

14. A lifting cushion that is wedge-shaped, comprising:

a top part and a bottom part with connecting walls and fillable with a fluid, and carrying handles arranged at a rearward edge, wherein the top part and the bottom part are a formable material and are joined to form an unbroken unit in a forward edge of the cushion, the forward edge is extended in relation to a front connecting wall, thereby forming a fore extended part that extends in front of and outside the front connecting wall, the front connecting wall extending substantially perpendicular to the bottom part in a filled state, the fore extended part is thin and stiff such that when the lifting cushion is filled with the fluid, the fore extended top part and the bottom part are expanded without preventing the fore extended part of the connecting wall from smoothing out and forming the fore part of the lifting cushion in a filled state, so that it is allowed to be interposable along a support under or between objects to be lifted, the top part and the bottom part have surfaces that are at least as large as a surface of the lifting cushion, the front connecting wall, sides, and a rearward edge of the cushion are a formable material, and a ratio of a height of the forward edge and a height of a rearward edge of an inflatable part of the cushion is approximately 1:3, the lifting cushion has decreased wedge-shape toward the forward edge, and the carrying handles are lifting belts at the corner areas of the cushion.

* * * * *